US010590730B2

(12) United States Patent
Eriksen

(10) Patent No.: US 10,590,730 B2
(45) Date of Patent: Mar. 17, 2020

(54) PACKER BOX AND METHOD FOR INSTALLATION OR WITHDRAWAL OF A PACKER ELEMENT IN, RESPECTIVELY FROM A PACKER BOX FOR USE IN PETROLEUM DRILLING

(71) Applicant: Electrical Subsea & Drilling AS, Straume (NO)

(72) Inventor: Egil Eriksen, Vassenden (NO)

(73) Assignee: ELECTRICAL SUBSEA & DRILLING AS, Straume (NO)

( * ) Notice: Subject to any disclaimer, the term of this patent is extended or adjusted under 35 U.S.C. 154(b) by 40 days.

(21) Appl. No.: 15/764,542

(22) PCT Filed: Sep. 28, 2016

(86) PCT No.: PCT/NO2016/050195

§ 371 (c)(1),
(2) Date: Mar. 29, 2018

(87) PCT Pub. No.: WO2017/058026

PCT Pub. Date: Apr. 6, 2017

(65) Prior Publication Data

US 2018/0355683 A1 Dec. 13, 2018

(30) Foreign Application Priority Data

Sep. 30, 2015 (NO) ..... 20151285
Jun. 22, 2016 (NO) ..... 20161044

(51) Int. Cl.
*E21B 33/02* (2006.01)
*E21B 33/03* (2006.01)
(Continued)

(52) U.S. Cl.
CPC ..... *E21B 33/085* (2013.01); *E21B 33/02* (2013.01); *E21B 33/03* (2013.01); *E21B 33/06* (2013.01); *E21B 33/068* (2013.01)

(58) Field of Classification Search
CPC ..... E21B 33/02; E21B 33/03; E21B 33/06; E21B 33/068; E21B 33/085
See application file for complete search history.

(56) References Cited

U.S. PATENT DOCUMENTS 1,942,366 A 1/1934 Seamark
5,178,215 A 1/1993 Yenulis et al.
(Continued)

FOREIGN PATENT DOCUMENTS

AU 20152344310 1/2015
EP 1519003 A1 3/2005
(Continued)

OTHER PUBLICATIONS

Norwegian Search Report for Application No. 20161044 dated Jan. 21, 2017.
(Continued)

*Primary Examiner* — Cathleen R Hutchins
(74) *Attorney, Agent, or Firm* — Patterson + Sheridan, LLP

(57) ABSTRACT

A packer box for use in petroleum drilling is described, in which a rotatable packer element arranged centrically in a packer retainer that is orientable and lockable in a sealing position in a housing in the packer box is arranged to seal against a passing drill string, the packer element comprising a mounting device provided with packer slide rings at the ends of the mounting device and being in sealing abutment against slide rings arranged internally in the packer retainer, and an internal, flexible packer sleeve which is arranged to abut sealingly against the drill string with an external pressure from a fluid in a volume-compensated annular space in the packer retainer, wherein the mounting device includes several channels perforating the mounting device, and clamping devices for fixing the packer sleeve to the end portions of the mounting device. A method of installing or
(Continued)

withdrawing a packer element in, respectively from, a packer box is described as well.

13 Claims, 8 Drawing Sheets

(51) Int. Cl.

| | |
|---|---|
| ***E21B 33/06*** | (2006.01) |
| ***E21B 33/068*** | (2006.01) |
| ***E21B 33/08*** | (2006.01) |

(56) References Cited

U.S. PATENT DOCUMENTS

| | | | |
|---|---|---|---|
| 6,167,959 | B1 | 1/2001 | Bassinger et al. |
| 2005/0133266 | A1 | 6/2005 | May et al. |
| 2009/0166046 | A1 | 7/2009 | Edvardson et al. |

FOREIGN PATENT DOCUMENTS

| | | | |
|---|---|---|---|
| NO | 324167 | B1 | 9/2007 |
| WO | 2010082831 | A1 | 7/2010 |
| WO | 2011093714 | A1 | 8/2011 |

OTHER PUBLICATIONS

Norwegian Search Report for Application No. 20151285 dated Mar. 30, 2016.

International Search Report for Application No. PCT/NO2016/050195 dated Dec. 7, 2016.

Written Opinion for Application No. PCT/NO2016/050195 dated Dec. 7, 2016.

PACKER BOX AND METHOD FOR INSTALLATION OR WITHDRAWAL OF A PACKER ELEMENT IN, RESPECTIVELY FROM A PACKER BOX FOR USE IN PETROLEUM DRILLING

The invention relates to a packer box for use in petroleum drilling, in which a rotatable packer element arranged centrically in a packer retainer which is orientable and lockable in a sealing position in a housing of the packer box is arranged to seal and accommodate geometric differences between passing drill pipes and tool joints of a drill string and also seal statically and during rotation of the drill string, wherein the packer element includes a perforated mounting device provided with packer slide rings at the ends of the mounting pipe and sealingly abuts against sliding surfaces of slide rings inside the packer retainer, and an internal, flexible packer sleeve which is arranged to rest in a sealing manner against the drill string with an external pressure from a fluid in a volume-compensated annular space in the packer retainer. The invention also includes a method for installing or withdrawing a packer element in, respectively from, a packer box for use in petroleum drilling.

Devices with sealing elements that accommodate geometric differences between passing, rotating drill pipes and tool joints are used in drilling in the petroleum industry, in managed pressure drilling (MPD) and dual gradient drilling (DGD), among other things. The equipment may be installed on the surface, be integrated in a riser between a vessel and a blowout preventer on a wellhead, or be mounted on the blowout preventer. The device is to seal against a drill string during drilling and cementation and direct returned drilling fluid from the well to a side outlet below the packer element, where it is connected to a pump and to a valve arrangement, which may be arranged in various ways, depending on what drilling technique is used. In MPD from a drilling rig, the packer box, the pump and the valve arrangement will typically be installed 300-400 metres below the drilling floor if the relevant sea depth is large enough. The pump is used to control the pressure below the packer box, and the well fluid is typically pumped on to the surface from below the packer box via a bypass arrangement and further in the riser above the packer box, possibly through a separate line connection to the surface. Centrifugal pumps are a relevant type of pump in MPD.

It is desirable to have an opening with a diameter of minimum 18¾" through the housing of the packer box, so that larger components can be passed through the packer box when the packer element is not installed. For riser applications the external diameter is limited by the opening in the rotary table of the drilling floor, for example 49½".

In the prior art, packer boxes with rotating packers and mechanical bearings are the most common. The sealing properties thereof are negatively affected by high rotational speeds.

U.S. Pat. No. 1,942,366 A discloses a packer box arranged to accommodate geometric differences between passing drill pipes and pipe connections. A housing accommodates a mounting pipe for a flexible packer sleeve, which, by means of a pressurized fluid in an enclosing annular space, may rest sealingly against the drill pipe.

GB 2425795 A discloses a packer box with packers rotating with the drill string.

Solutions with passive, non-rotating, packers based on the injection of lubricants have been developed. These are tolerant to high rotational speeds, but laborious to operate.

NO 324167 B1 discloses a packer box consisting of a dynamic seal with a seal unit and a receiving unit. The seal unit consists of three seals, and the spaces between the seals are filled with grease for lubrication and pressure support to the seals.

The solutions mentioned have in common that the packers are very much subjected to wear, which may result in interruptions in operations with costly replacements of packer elements. Another drawback is limited tolerance to misalignment of the drill string.

NO 332900 B1 discloses a rotating packer box with a flexible sealing sleeve enclosing a drill string in a cylindrical housing. The sleeve is surrounded by a pressurized annular space filled with fluid and seals against the drill pipe, whereas the ends of the sleeve seal against, respectively, upper and lower sets of hydraulically actuated supporting plates. The supporting plates are provided with cut-outs that form an opening for the tool joints of the drill string when the plates are in their inner positions. The plates may be retracted by means of actuators, so that equipment of a larger diameter is allowed to pass through the packer box. The packer element is extracted from, or installed in, the packer box with the drill string.

The invention has for its object to remedy or reduce at least one of the drawbacks of the prior art or at least provide a useful alternative to the prior art.

The object is achieved according to the invention through the features that are specified in the description below and in the claims that follow.

The invention is to contribute to a lasting seal of high wear strength and long life at high differential pressures and high rotational speeds of the drill string, for example 200 revolutions per minute. The packer box is to absorb misalignment, play and lateral forces from the drill string. With a flexible, pressure-assisted sleeve sealing around the drill string, it is also possible, when required, to let well fluid through the packer box in a controlled manner. This is different from the prior art which is based on the use of passive packers. The invention is to help to make the packer box a slender structure with a large opening, when the packer retainer is not installed. The packer retainer with the packer element is preferably handled with the drill string, or, alternatively, it may be moved along the drill string with the help of a suitable tool.

The following features will contribute to this:

- A cylindrical packer retainer is oriented and locked in the housing of the packer box, with sealing against the inside of the housing.
- A drill string passes through the centre of the packer box via openings in the packer retainer and an internal, rotatable packer element.
- The packer element consists of a flexible packer sleeve encircling the drill string, and an outer mounting device for the sleeve.
- The ends of the packer element are mounted between supporting rings at the upper and lower end pieces of the packer retainer.
- The supporting rings are provided with linings with openings for the relevant drill-pipe dimension, and integrated slide-rings functioning as slide bearings, sealing statically and dynamically against opposite slide rings at the ends of the packer element.
- The outer mounting device of the packer sleeve is provided with a number of channels for external pressure support to the flexible packer sleeve.

When the annular space in the packer retainer is pressurized from the outside, the packer element will rotate with the drill string, the sleeve being clamped sealingly around the drill pipe.

The flexible packer sleeve may be provided with embedded, industrial-ceramics wear elements abutting against the drill string.

The packer sleeve will take axial wear from a passing drill string, whereas rotational wear will be taken by slide rings between the packer retainer and the packer element.

The packer retainer is preferably hung on and moved by means of the drill string, by a coupling device, gripping loosely around a drill string and abutting against the shoulder on a tool joint, being releasably connected to the packer retainer before being moved by vertical displacement of the drill string.

Alternatively, a tool may be brought to grip an upper entry cone on the packer retainer for handling. The tool is preferably connected as part of the drill string and is moved into connection with the packer retainer by displacement of the drill string. The packer retainer is then moved by vertical displacement of the drill string.

In a further alternative, a tool, which, in itself, is independent of the drill string may be moved along the drill string and locked to the upper part of the packer retainer. In this case, the packer retainer is moved with a packer sleeve, unpressurized in this case, along the drill string.

The present application relates to a packer box for a drill string, the packer box comprising a replaceable packer retainer and a packer element accommodating geometric differences between passing drill pipes and tool joints.

The invention also relates to a method for installing and withdrawing a packer retainer with a sealing element in or out of the housing of the packer box, in which:

A drill string with a drill bit is lowered through the housing of the packer box. The packer retainer with the packer element is slid onto a drill pipe and a gripping device on the packer retainer is engaged, so that the packer retainer hangs loosely on a tool joint. The drill pipe with the packer retainer and seal element is screwed into the drill string and lowered to the packer-box housing and landed therein.

An orientation pin at the bottom of the housing of the packer box is extended, so that the packer retainer is rotated in position by the pin by means of an orientation collar on the bottom side of the packer retainer before the packer retainer is landed on the orientation pin. The device that is gripping loosely around the drill pipe is disengaged, and locking pins and coupling devices for hydraulics are extended into the packer retainer.

Release and withdrawal of the packer retainer with the drill string are done by reversing the steps described for the installation, by a device gripping loosely around the drill pipe before the upper locking pins and coupling devices for hydraulics are retracted. When a tool joint hits the device gripping around the drill pipe, the packer retainer is lifted out of the housing and goes with the drill string to the surface. The lower locking pins are retracted when the packer retainer is hanging on the pipe. The orientation pin is always kept in the extended position when the packer retainer is being handled.

The packer retainer may alternatively be installed or withdrawn to the surface with a tool. The tool is locked to an external locking groove on an upper entry cone for the tool joints of the drill string on the top of the packer retainer.

The method for landing, locking, connecting hydraulics and releasing the packer retainer corresponds to what has been described for handling with a drill string, apart from the device that is arranged to grip around the drill pipe being retracted at all times, so that the packer retainer can be moved freely along the drill string.

During short stops in the drilling operation, typically in connection with new drill pipes being added to the string, it may be desirable to avoid starting and stopping the pump, which helps, during drilling, to control the pressure on the bottom side of the packer element and pumps the drilling fluid on to the surface. A centrifugal pump, which will typically be used for the purpose, may be kept running while pumping against a closed valve until drilling is resumed. A limitation of such a method is that the pump must be stopped before it gets too warm. With the solution of the application, a new method may be introduced to achieve cooling of the pump, by the pressure support for the flexible sleeve being reduced, so that the packer box is partially opened to flow so that a temporary circulation circuit is formed from the bottom side of the packer element, through the pump, in at the top side of the packer element, down through the packer element and out again to the suction side of the pump.

The invention is defined by the independent claims. The dependent claims define advantageous embodiments of the invention.

In a first aspect, the invention relates more specifically to a packer box for use in petroleum drilling, wherein a rotatable packer element arranged centrically in a packer retainer that is orientable and lockable in a sealing position in a housing of the packer box is arranged to seal against and accommodate geometric differences between passing drill pipes and tool joints in a drill string and seal statically and during rotation of the drill string, wherein the packer element comprises a mounting pipe provided with packer slide rings at the ends of the mounting pipe, the packer slide rings being in sealing abutment against sliding surfaces of slide rings arranged internally in the packer retainer, and an internal, flexible packer sleeve which is arranged to abut sealingly against the drill string with an external pressure from a fluid in a volume-compensated annular space in the packer retainer, characterized by the mounting pipe comprising a perforated middle section, a clamping device for fixing the packer sleeve and the packer slide rings at the ends of the mounting pipe.

The ends of the packer element may rest against supporting rings arranged at an upper end piece and a lower end piece of the packer retainer, the supporting rings being provided with linings with openings adapted to the dimension of the drill string.

The packer sleeve may comprise an internal, wear-resistant layer and an outer sheath.

A fluid-volume compensator may be connected to the annular space.

The packer retainer may comprise a gripping device comprising at least one hydraulically actuated, spring-loaded locking bolt arranged to releasably engage with the drill pipe by abutment against a shoulder of the tool joint.

An upper entry cone for the tool joints of the drill pipe arranged on an upper end piece of the packer retainer may be designed for the connection of a tool for installing or withdrawing the packer retainer.

The packer sleeve may be provided with at least one wear sensor connected to an electronic transmitter for wireless signal transmission to a receiver connected to a control system arranged to monitor at least the condition of the packer sleeve. The electronic transmitter may include means generating signals induced by the rotation of the packer element.

The housing may be provided with a fluid-circulation circuit, which comprises a pressure-fluid inlet for the supply of a pressurized fluid, typically filtered sea water, to the annular space for pressure support to the packer element, and possibly a pressure-fluid outlet for controlled outlet of the pressurized fluid from the annular space to cool the packer box.

The housing may be provided with a drilling-fluid outlet arranged below the packer element for the return of drilling fluid to the surface, possibly via a bypass arrangement arranged between the drilling-fluid outlet and a drilling-fluid inlet arranged in the housing above the packer element.

In a second aspect, the invention relates more specifically to a method of installing or withdrawing a packer element in, respectively from, a packer box for use in petroleum drilling, characterized by the method comprising the features of: either 1a) sliding a packer retainer as described above onto a drill pipe;

1b) letting a gripping device grip loosely around the drill pipe by at least one hydraulically actuated, spring-loaded locking bolt arranged on the packer retainer being brought into abutment against a shoulder on a tool joint of the drill pipe;

1c) connecting the drill pipe to a drill string;

1d) by means of the drill string, inserting the packer retainer into a housing;

1e) locking the packer retainer to the housing; and 1f) releasing the drill string from the packer retainer by pulling the at least one locking bolt away from the shoulder of the tool joint;

or 2a) sliding the packer retainer onto a drill pipe;

2b) letting a tool grip an upper entry cone as described above;

2c) connecting the drill pipe to a drill string;

2d) by means of the tool, inserting the packer retainer into a housing;

2e) locking the packer retainer to the housing; and 2f) releasing the tool from the packer retainer; and when extracting the packer element from the housing, reversing either steps 1*a*-1*f* or steps 2*a*-2*f*.

The method may include the further step of:

orienting the packer retainer in the housing by letting an inclined guiding surface of an orientation collar in a lower end portion of the packer retainer slide on an orientation pin that projects into the housing in order thereby to rotate the packer retainer.

In what follows, an example of a preferred embodiment is described, visualized in the accompanying drawings in which.

Figure 1:
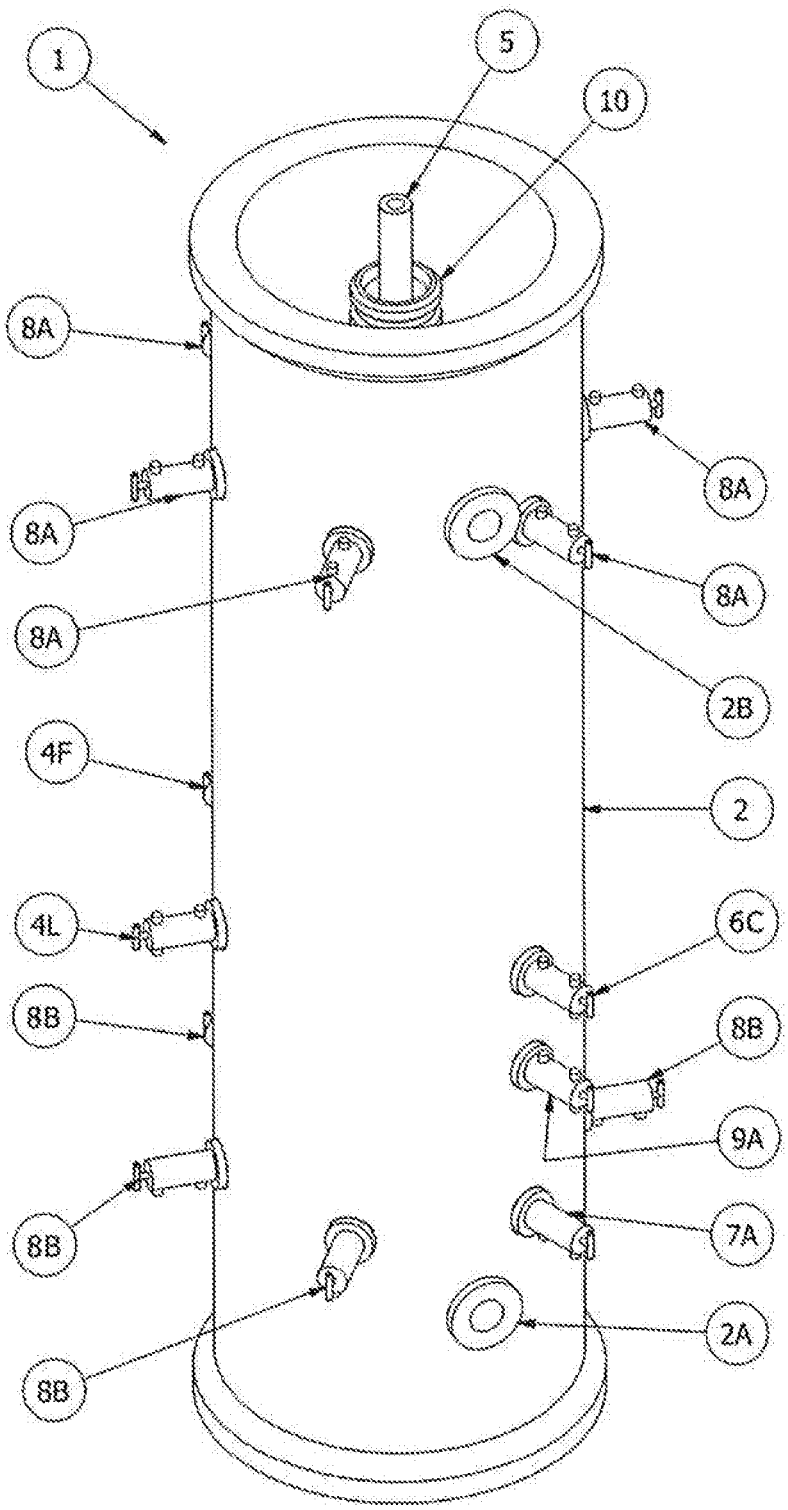
FIG. 1 shows, in perspective, a packer box with a drill string extending through it, the housing being provided with actuators according to the invention.

In the drawings, the reference numeral 1 indicates a tubular packer box for sealingly passing a drill string in petroleum drilling. The packer box 1 comprises a housing 2 with a drilling-fluid outlet 2A for the connection of a pump and a valve arrangement for managed pressure drilling (MPD) and a drilling-fluid inlet 2B for drilling mud. The housing 2 may have adapters for a riser (not shown) at its upper and lower ends, or be adapted for connection to other elements not shown. In extensive handling of the packer box 1 it is relevant to fit a cover (not shown) around the housing 2 to protect external equipment and connections.

Figure 2:
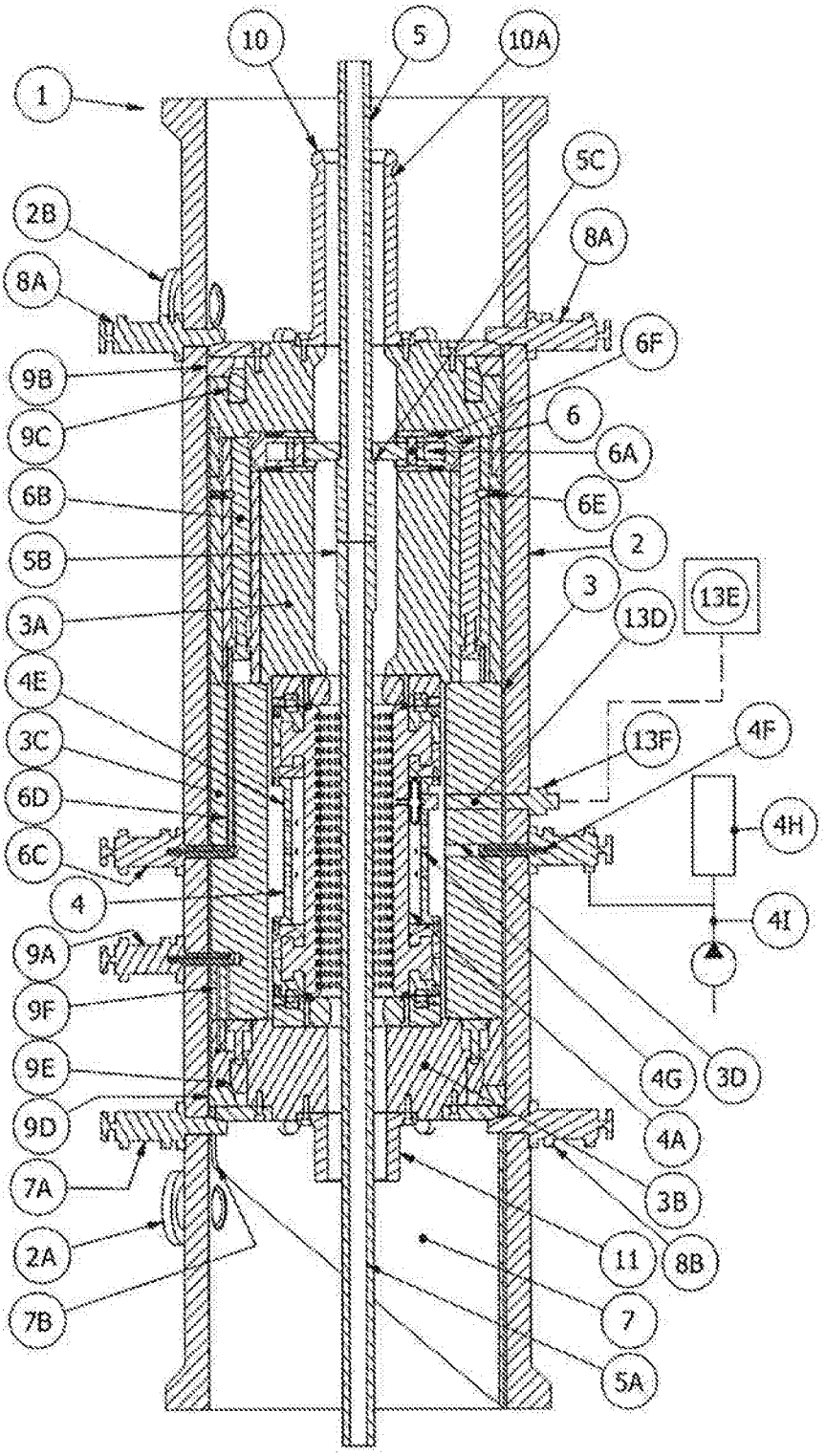
FIG. 2 shows an axial section through the packer box and drill string.
Figure 3:
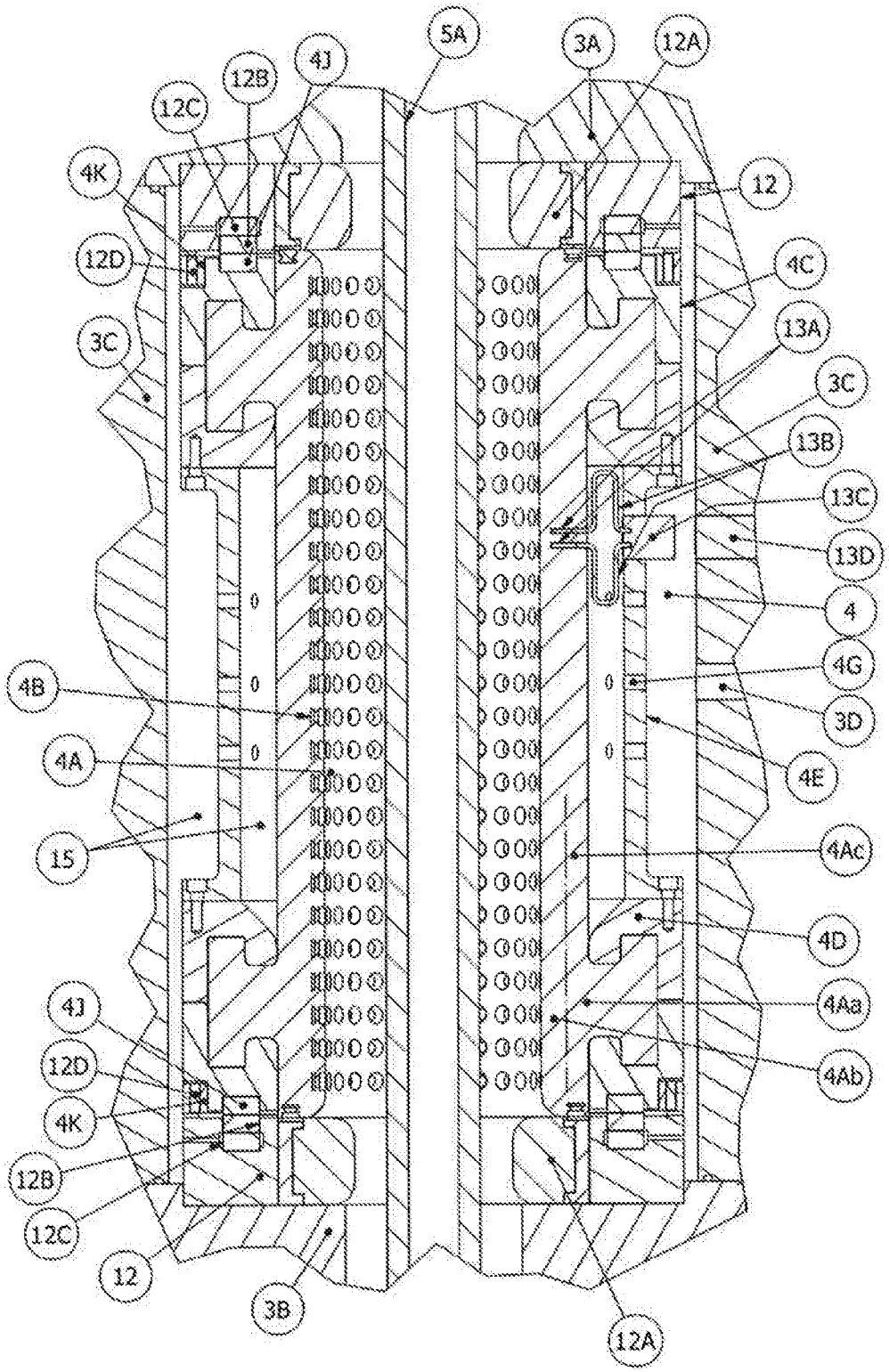
FIG. 3 shows, on a larger scale, an axial section through a packer element.

Reference is now made to FIGS. 2 and 3. In the housing 2, a cylindrical packer retainer 3 with a rotatable packer element 4 is disposed. The packer retainer 3 comprises upper and lower end pieces 3A, 3B and a cylindrical middle section 3C.

A drill string 5 comprising a number of drill pipes 5A with tool joints 5B may pass axially through openings in an upper end piece 3A and a lower end piece 3B in the packer retainer 3 and through the packer element 4. The tool joints 5B are provided with shoulders 5C.

The packer element 4 includes a flexible packer sleeve 4A which is provided with embedded, industrial-ceramics wear elements 4B, and which is formed, at either end, with a reinforced mounting collar 4Aa which is clamped with upper and lower clamping devices 4C, 4D, respectively, at the ends of an outer mounting device 4E on the packer element 4. The packer sleeve 4A, shown unpressurized, may be moulded in one piece, or consist of an inner layer 4Ab with wear elements 4B and an outer sheath 4Ac which has been moulded or glued together with the inner layer. The packer sleeve 4A is dimensioned in relation to the dimension of the drill string 5. The packer element 4 rotates with the drill string 5 as the packer sleeve 4A is clamped sealingly around the drill string 5 by external pressure support with a fluid in the packer element 4.

Figure 8:
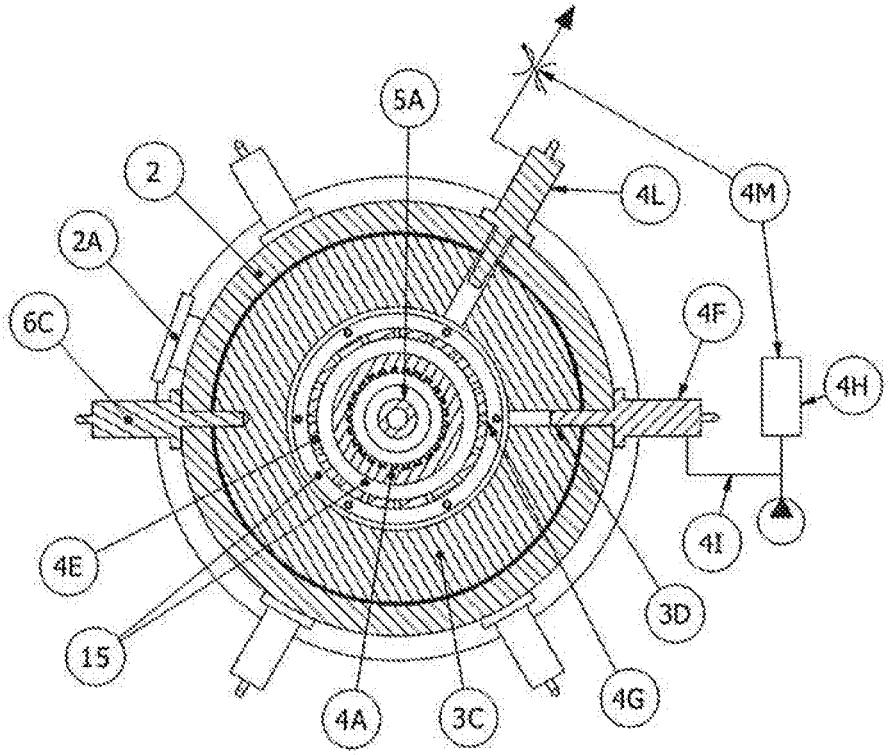
FIG. 8 shows, on a larger scale, a radial section through the packer box and a schematic representation of the arrangement for pressurizing the flexible packer sleeve with an inlet and an outlet.

The medium for pressure support is typically filtered sea water which is pumped in through a coupling device 4F, further through a horizontal bore 3D in a middle section 3C of the packer retainer 3 and in to the packer sleeve 4A via a number of channels 4G through the outer mounting device 4E of the packer sleeve 4A. A fluid-volume compensator 4H compensates for a volume change in the packer retainer 3 when tool joints 5B are passing through the packer sleeve 4A and is preferably connected to a supply line 41 for pressurization fluid on the outside of the packer box 1. Cooling inside the packer box 1 can possibly be provided by the pressurization fluid being pumped into and being let out in a controlled manner from the packer retainer 3 into the surroundings through bores in the packer retainer 3 and corresponding couplings 4F, 4L in the housing 2 and an associated fluid-circulation circuit 4M, as is shown in FIG. 8.

Figure 4:
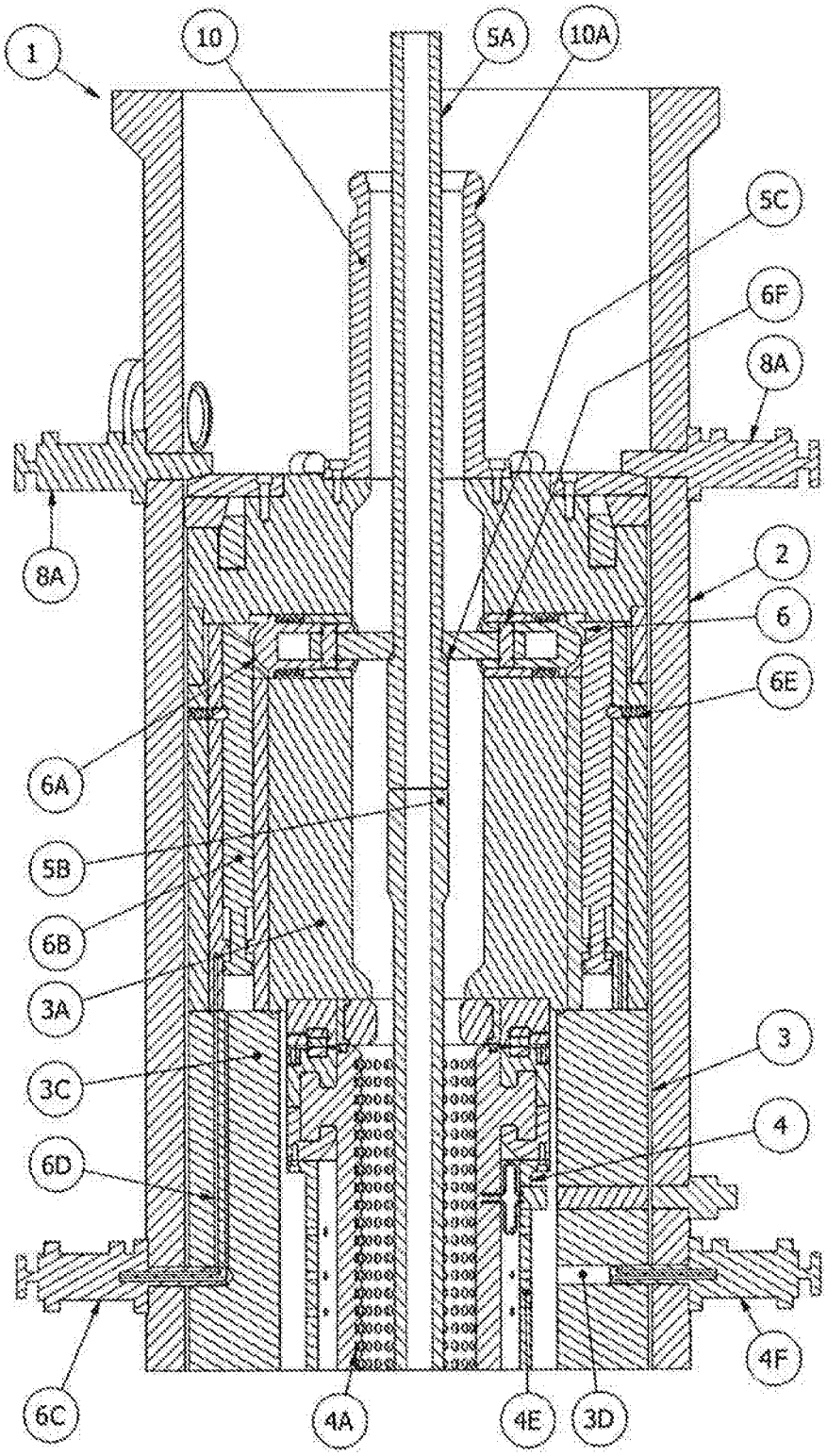
FIG. 4 shows, on a smaller scale, a drill string and a device for handling the packer retainer by means of the drill string connected to the packer retainer of the packer box.

Reference is now made to FIG. 4. A gripping device 6 for handling the packer retainer 3 and the packer element 4 by means of the drill string 5 is integrated in the upper end piece 3A of the packer retainer 3. By abutting against the shoulder 5C of a tool joint 5B, a number of spring-loaded locking bolts 6A are arranged to grip loosely around the drill pipe 5A when the packer retainer 3 is to be inserted into the housing 2, possibly when the packer retainer 3 is to be pulled out of the housing 2 and up to the surface. The locking bolts 6A are pushed in towards the drill pipe 5A by inclined surfaces at the upper end of a number of hydraulic actuators 6B, dedicated to the respective locking bolts 6A, and are placed in vertically oriented bores encircling the centre opening in the upper end piece 3A. In the upper end position, the inclined surfaces on the top of the actuators 6B are on the top side of the actuation end of the bolts 6A, and spring return of the bolts 6A is prevented.

At the lower end of the hydraulic actuators 6B, piston heads are arranged for hydraulic activation of the actuators 6B, and they are pressurized from a coupling device 6C via bores 6D in the middle section 3C of the packer retainer 3. The bores 6D have their respective mouths above and below the piston heads of the hydraulic actuators 6B.

Spring-loaded retaining devices 6E are arranged in the upper end piece 3A of the packer retainer 3 for each actuator 6B, so that they are held locked in the upper position when the hydraulic pressure is vented. Mechanical locking of the actuators 6B is overcome by the actuators 6B being returned to the lower position by hydraulic pressure on the upper side of the piston heads.

When the packer retainer 3 is installed in the housing 2, the hydraulic pressure passes through the coupling device 6C on the outside of the housing 2. In the case of the packer retainer 3 being on the surface, hydraulic hoses may be connected directly to the bores 6D in the middle section 3C of the packer retainer 3 for the release of the actuators 6B.

To avoid coupling hydraulic devices in an unclean environment, the locking bolts 6A may alternatively be actuated hydraulically from the outside of the housing 2. This is typically done by means of three sets of two cylinders, one set for each of three locking bolts 6A altogether. The cylinders operate three mechanical transmissions for the locking bolts 6A, directly through the pipe wall of the housing 2. A first cylinder is used to push the locking bolt in, and a second cylinder to hold the locking bolt in the locked position. In normal operation, both cylinders have been returned to the outer starting position. The solution is not shown in the figures.

When the bolts 6A have been pushed in towards the drill pipe 5A and the packer retainer 3 has been released from the housing 2, the packer retainer 3 with the packer element 4 hangs on the shoulder 5C of one of the tool joints 5B of the drill string 5 and is handled with this.

Shear pins 6F are included in the bolts 6A as a safety device in case the packer retainer 3 sticks in the riser.

Figure 5:
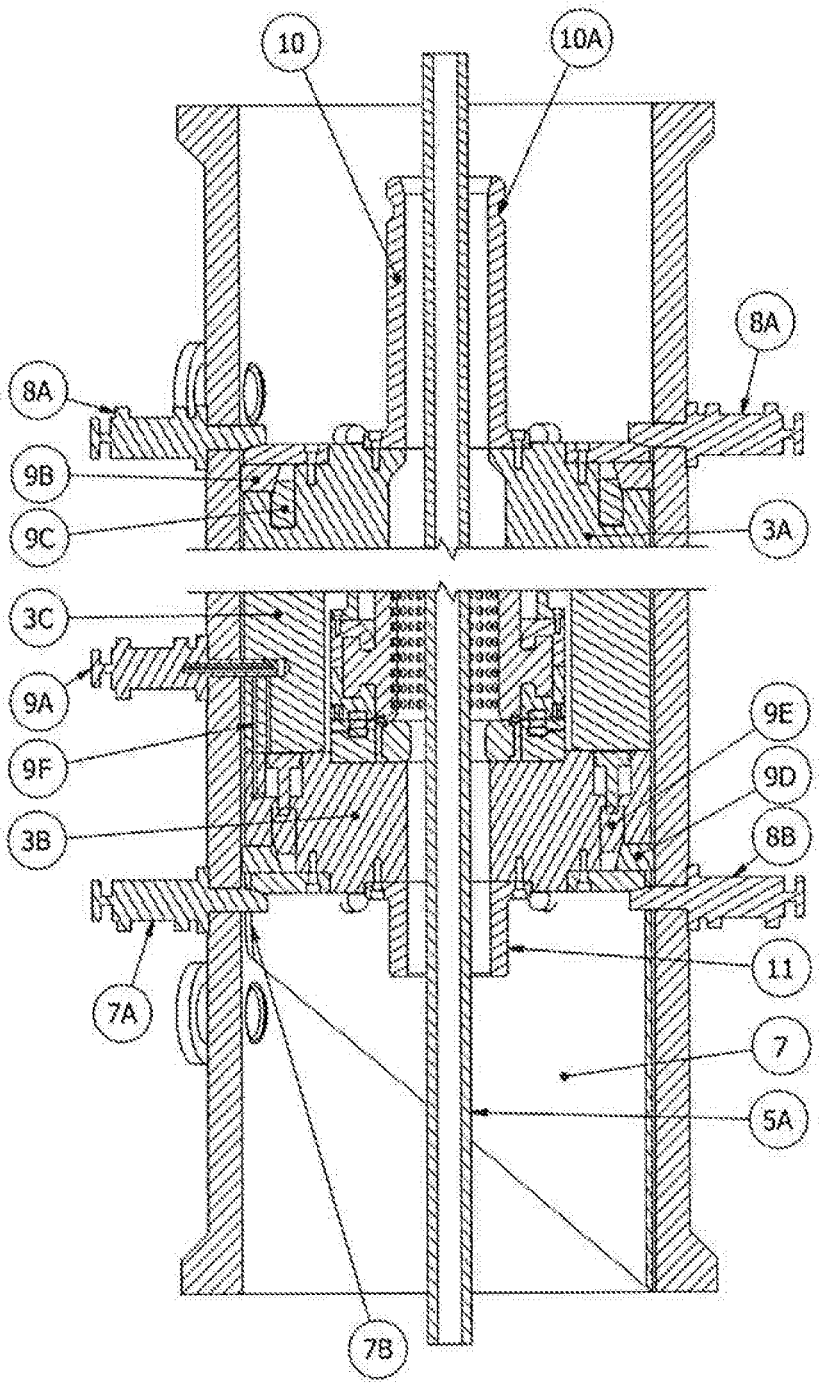
FIG. 5 shows, on a smaller scale, a view corresponding to FIG. 4, during hydraulic activation of the upper and lower packers between the housing and the packer retainer.

Reference is now made to FIG. 5. The packer retainer 3 is rotated around its axis while being lowered into the housing 2 during installation in order to align with corresponding elements in the housing 2, by an orientation collar 7 on the bottom side of the packer retainer 3 hitting an orientation pin 7A and the packer retainer 3 being rotated into the correct orientation in the housing 2 as the edge of the orientation collar 7 slides down along the orientation pin 7A. At the top of the orientation collar 7, the orientation pin 7A will bottom in a vertical slit 7B when the packer retainer 3 is landed in the housing 2.

The packer retainer 3 is locked to the housing 2 of the packer box 1 with upper and lower sets of locking pins 8A, 8B which are arranged to engage with cut-outs in the packer retainer 3 to attach the packer retainer 3 to the housing 2.

A hydraulic coupling device 9A is arranged on the housing 2 for the activation of upper and lower packers 9B, 9D between the housing 2 and the packer retainer 3 by means of hydraulic actuation devices 9C, 9E with pistons that are pressurized via bores 9F in the middle section 3C of the packer retainer 3 and in the upper and lower end pieces 3A, 3B, respectively, of the packer retainer 3.

Alternatively, the lower packer 9D is activated by means of the weight that is put down as the packer retainer 3 is landed in the housing 2, whereas the upper packer 9B is activated hydraulically from the outside of the housing 2, via mechanical transmission through the pipe wall of the housing 2. The solution is not shown in the figures.

The upper and lower end pieces 3A and 3B, respectively, of the packer retainer are each provided with an entry cone 10 and 11, respectively, for the tool joints 5B. An upper entry cone 10 is shown in FIG. 2 with an external locking groove 10A for the connection of a tool (not shown) for installing or withdrawing the packer retainer 3.

In the event of the shear pins 6F breaking, the packer retainer 3 will slide down along the drill string 5 before landing on the orientation pin 7A in the housing 2. In controlled shearing of the pins 6F, a handling tool may first be connected to the locking groove 10A.

A flexible cuff (not shown) may be placed on the entry cone 10 and seal around the drill string 5.

Figure 6:
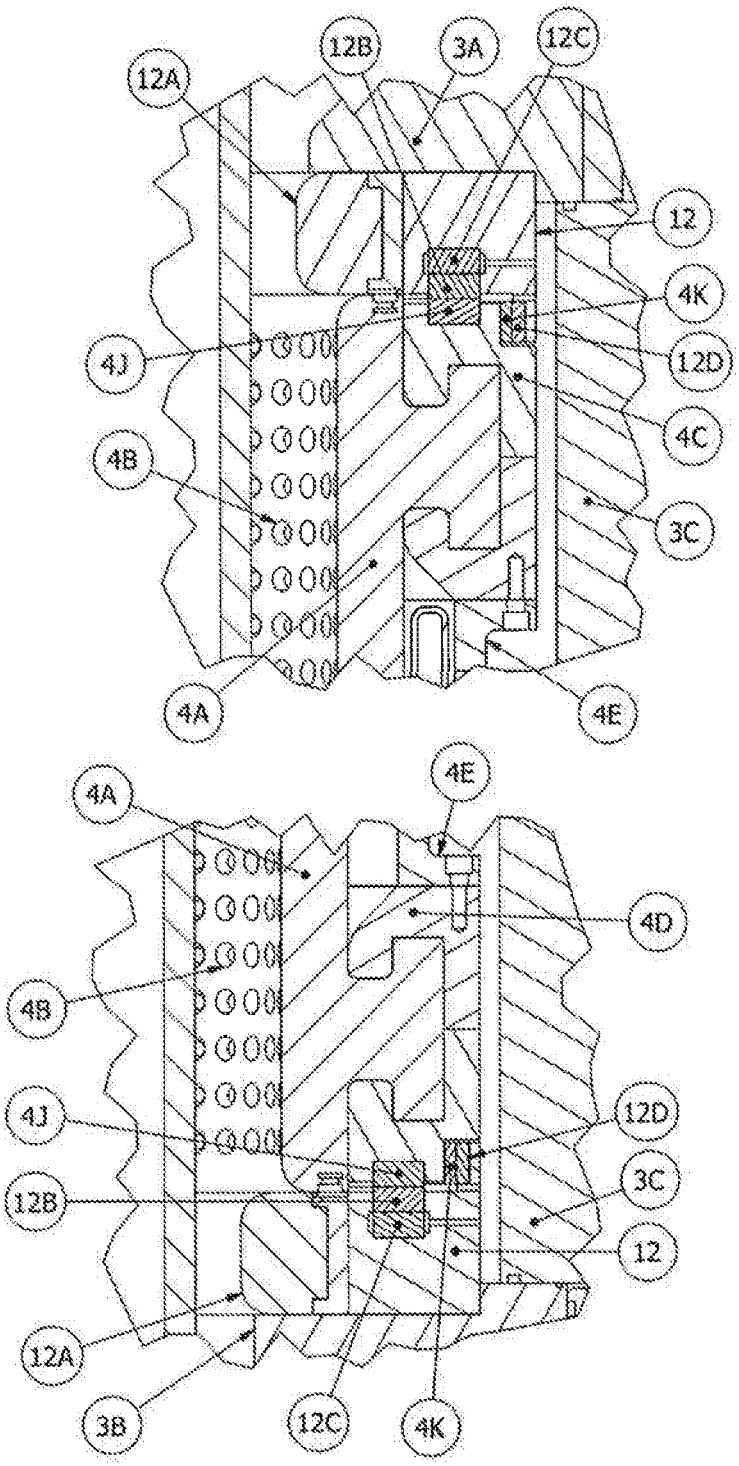
FIG. 6 shows, on a larger scale, a section of the support of the rotatable packer element and the clamping devices for mounting the flexible packer element of FIG. 2.

Reference is now made to FIG. 6. Inside the packer retainer 3, on the bottom side of the upper end piece 3A and on the top side of the lower end piece 3B, supporting rings 12 (see FIG. 3) are mounted with integrated linings 12A for the centre opening through the packer retainer 3, adapted to the relevant dimension of the drill string 5. Floating slide rings 12B with anti-rotational mounting are integrated in the supporting rings 12 and work as sliding bearings and dynamic packer rings. The packer element 4 is mounted between the slide rings 12B in the upper and lower supporting rings 12 in the packer retainer 3 by the slide rings 12B abutting against resilient elements 12C in the supporting rings 12 and being in axial, sealing engagement with sliding surfaces on the packer slide rings 4J which are attached to the clamping devices 4C, 4D on the mounting device 4E of the packer sleeve 4A. The supporting rings 12 are also provided with radial slide rings 12D abutting against the packer slide rings 4K that are attached to the clamping devices 4C, 4D.

The slide rings 12B, 12D, 4J, 4K are typically made from an industrial-ceramics material.

Reference is made to FIGS. 2 and 3. The packer sleeve 4A may be provided with at least one wear sensor 13A in the form of embedded electrodes that come into contact with the drill string 5 as the packer sleeve 4A wears down to a critical level. The wear sensor 13A is connected via flexible wiring 13B to a combined rotation-signal transducer and electronic transmitter 13C in the outer mounting device 4E of the packer element 4. An electronic receiver 13D in the packer retainer 3 records signals from the wear sensor and revolutions of the packer element 4, for example by the transmitter 13C including means, typically a magnet (not shown), inducing a signal in the receiver 13D every time it passes the receiver 13D. The signals are transmitted to a control system 13E from an electrical connector 13F which is inductively connected to the receiver 13D and is arranged in the housing 2.

Figure 7:
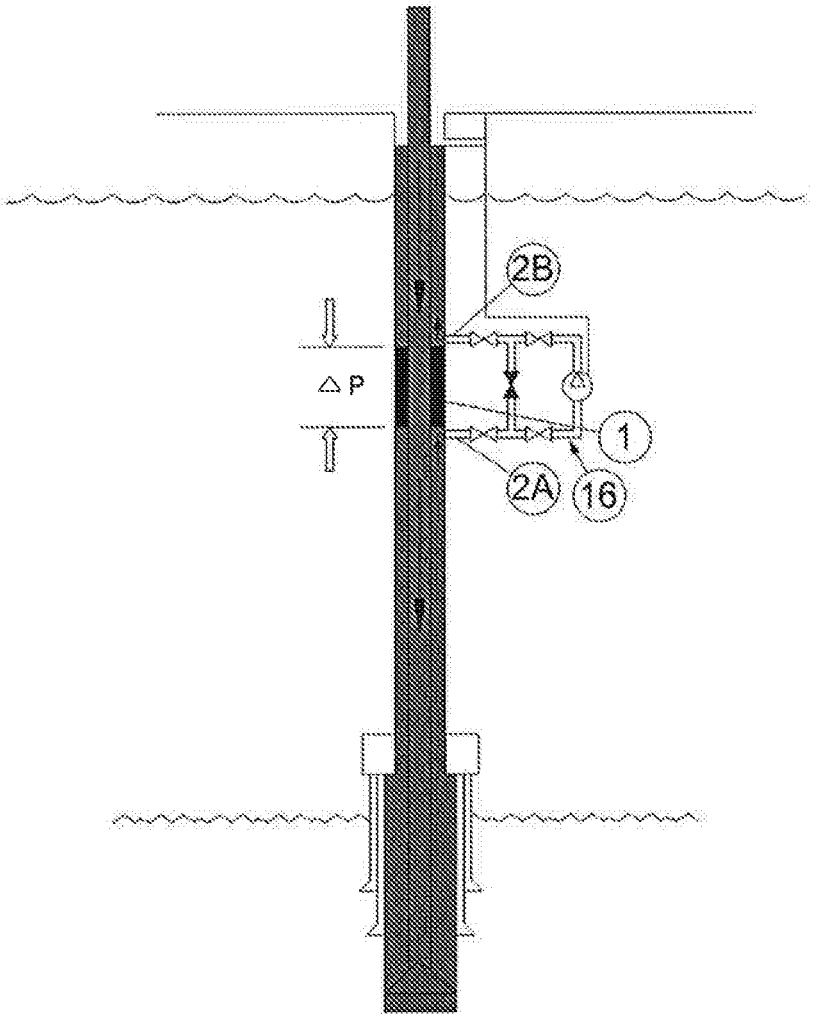
FIG. 7 shows, on a smaller scale, the packer box mounted in a drilling riser with an external bypass arrangement, and also an inlet and an outlet for drilling fluid below and above the packer element.

In FIG. 7, the packer box 1 is shown schematically as mounted in a riser with an external bypass arrangement 16 and an outlet 2A and an inlet 2B for drilling fluid below and above the packer element 4, respectively.

To avoid cuttings accumulating on the top of the packer retainer 3, with the risk of cuttings penetrating into the clearance between the packer retainer 3 and the inside of the housing 2, a flexible bellows that encloses the lower part of the entry cone 10 may be fitted on the top of the packer retainer 3. The bellows is formed with a slanted top side, sloping towards the inlet 2B. Returning drilling fluid will then have better flow conditions, so that the precipitation of particles onto the top of the packer retainer is avoided. The bellows is pressurized from the inside, so that it will seal against the inside of the housing 2. The bellows may be made of a wear-resistant elastomer material, for example polyurethane. The solution is not shown in the figures.

It should be noted that all the above-mentioned embodiments illustrate the invention, but do not limit it, and persons skilled in the art may construct many alternative embodiments without departing from the scope of the attached claims. In the claims, reference numbers in parentheses are not to be regarded as restrictive. The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A packer box for use in petroleum drilling, comprising:

a rotatable packer element arranged centrically in a packer retainer that is orientable and lockable in a sealing position in a housing in the packer box, the rotatable packer element being arranged to seal against and accommodate geometric differences between passing drill pipes and tool joints in a drill string, and seal during rotation and radial displacement of the drill string, wherein the packer element comprises:

a mounting device provided with packer slide rings at the ends of the mounting device, the packer slide rings being in sealing abutment against sliding surfaces of slide rings arranged internally in the packer retainer, an internal, flexible packer sleeve which is arranged to abut sealingly against the drill string with an external pressure from a fluid in a volume-compensated annular space in the packer retainer, the mounting device includes several channels perforating the mounting device, and clamping devices for fixing the packer sleeve to the end portions of the mounting device, and the packer sleeve is provided with at least one wear sensor connected to an electronic transmitter for wireless signal transmission to a receiver connected to a control system arranged to at least monitor the condition of the packer sleeve.

2. The packer box according to claim 1, wherein the ends of the packer element rest against supporting rings arranged at an upper end piece and a lower end piece of the packer retainer; the supporting rings being provided with linings with openings adapted to the dimension of the drill string.

3. The packer box according to claim 1, wherein the packer sleeve comprises an internal, wear-resistant layer and an outer sheath.

4. The packer box according to claim 1, wherein a fluid-volume compensator is connected to the annular space.

5. The packer box according to claim 1, wherein the packer retainer comprises a gripping device including at least one hydraulically actuated, spring-loaded locking bolt arranged to releasably engage with the drill pipe by abutment against a shoulder of the tool joint.

6. The packer box according to claim 1, wherein an upper entry cone for the tool joints of the drill pipe arranged on an upper end piece of the packer retainer is designed for the connection of a tool for installing or withdrawing the packer retainer.

7. The packer box according to claim 1, wherein the electronic transmitter includes means generating signals induced by the rotation of the packer element.

8. The packer box according to claim 1, wherein the housing is provided with a fluid-circulation circuit including a fluid inlet for the supply of a pressurized fluid to the annular space for pressure support to the packer element.

9. The packer box according to claim 1, wherein the housing is provided with a drilling-fluid outlet arranged below the packer element for return of drilling fluid to the surface.

10. The packer box according to claim 1, wherein the housing is provided with a fluid-circulation circuit including a fluid inlet for the supply of a pressurized fluid to the annular space for pressure support to the packer element, and a pressurized-fluid outlet for controlled outlet of the pressurized fluid from the annular space to cool the packer box.

11. The packer box according to claim 1, wherein the housing is provided with a fluid-circulation circuit including a fluid inlet for the supply of pressurized, filtered sea water to the annular space for pressure support to the packer element.

12. The packer box according to claim 1, wherein the housing is provided with a fluid-circulation circuit including a fluid inlet for supplying pressurized, filtered sea water to the annular space for pressure support to the packer element, and a pressurized-fluid outlet for controlled outlet of the pressurized, filtered sea water from the annular space to cool the packer box.

13. The packer box according to claim 1, wherein the housing is provided with a drilling-fluid outlet arranged below the packer element for return of drilling fluid to the surface via a bypass arrangement arranged between the drilling-fluid outlet and a drilling-fluid inlet arranged in the housing above the packer element.

* * * * *